US006964139B2

(12) United States Patent
Meyer et al.

(10) Patent No.: US 6,964,139 B2
(45) Date of Patent: Nov. 15, 2005

(54) PRECAST CONCRETE COLUMN FOR USE IN POST-FRAME CONSTRUCTION

(75) Inventors: Robert L. Meyer, Bluffton, IN (US); Phillip T. Stoller, Bluffton, IN (US)

(73) Assignee: Perma-Column, Inc., Craigville, IN (US)

( * ) Notice: Subject to any disclaimer, the term of this patent is extended or adjusted under 35 U.S.C. 154(b) by 224 days.

(21) Appl. No.: 10/085,333

(22) Filed: Feb. 28, 2002

(65) Prior Publication Data

US 2003/0159381 A1 Aug. 28, 2003

(51) Int. Cl.[7] ..... E02D 27/42

(52) U.S. Cl. ..... 52/299; 52/93.2; 52/170; 52/297; 248/188.4; 248/188.91; 248/231.91; 248/237; 248/357; 405/239; 405/256

(58) Field of Search ..... 52/93.1, 93.2, 52/170, 297, 299; 248/188.4, 188.91, 231.91, 237, 357; 405/239

(56) References Cited

U.S. PATENT DOCUMENTS

| | | | | |
|---|---|---|---|---|
| 864,854 A | | 9/1907 | Murray | |
| 887,217 A | | 5/1908 | Oliphant | |
| 943,747 A | | 12/1909 | Hickman | |
| 1,094,741 A | | 4/1914 | Oliphant | |
| 1,292,012 A | | 1/1919 | Morris | |
| 1,544,863 A | | 7/1925 | Ross | |
| 4,059,931 A | | 11/1977 | Mongan | |
| 4,096,677 A | * | 6/1978 | Gilb | 52/297 |
| 4,192,188 A | * | 3/1980 | Worley | 73/863.83 |
| 4,199,908 A | * | 4/1980 | Teeters | 52/295 |
| 4,272,929 A | * | 6/1981 | Hanson | 52/40 |
| 4,312,160 A | * | 1/1982 | Wilbanks | 52/92 |
| 4,386,762 A | * | 6/1983 | Collins | 256/59 |
| 4,458,463 A | * | 7/1984 | Behrend | 52/295 |
| 4,479,342 A | | 10/1984 | Eberle | |
| 4,543,757 A | * | 10/1985 | Cosgrove | 52/295 |
| 4,767,095 A | * | 8/1988 | Fitzgerald et al. | 249/48 |
| 4,918,891 A | | 4/1990 | Gerszewski | |
| 4,924,648 A | | 5/1990 | Gilb et al. | |
| 5,203,817 A | * | 4/1993 | Klumpjan | 52/298 |
| 5,234,288 A | * | 8/1993 | Bone | 405/239 |
| 5,291,709 A | | 3/1994 | Vranjesevic | |
| 5,375,384 A | * | 12/1994 | Wolfson | 52/295 |
| 5,437,519 A | | 8/1995 | Bullivant | |
| 5,561,950 A | * | 10/1996 | Collins et al. | 52/126.6 |
| 5,666,774 A | * | 9/1997 | Commins | 52/298 |
| 5,689,927 A | | 11/1997 | Knight, Sr. | |

(Continued)

OTHER PUBLICATIONS

Brochure—Post–Frame Construction, Southern Forest Products Association, Southeastern Lumber Manufacturers Association and National Frame Builders Association.

(Continued)

*Primary Examiner*—Carl D. Friedman
*Assistant Examiner*—Yvonne M. Horton
(74) *Attorney, Agent, or Firm*—Baker & Daniels

(57) ABSTRACT

A column for use in post-frame construction having a two piece construction in which a first or foundation column portion of the column is set into the earth with a proximal end thereof protruding from the earth. The proximal end of the foundation column includes a column bracket for joining the foundation column to a wooden column comprising the second portion of the two piece column of the present invention. The foundation column of the present invention comprises a precast concrete column. The foundation column of the present invention advantageously resists degradation of its mechanical properties due to environmental influences while providing the necessary strength to support a post-frame building, including, e.g., the environmental loads received by the building. The wood column comprising the second portion of the two piece column of the present invention advantageously provides ease of workability to complete construction of a post-frame building.

12 Claims, 6 Drawing Sheets

U.S. PATENT DOCUMENTS

| | | | | | |
|---|---|---|---|---|---|
| 6,230,449 | B1 | * | 5/2001 | Colvin, Jr. | 52/164 |
| 6,230,465 | B1 | | 5/2001 | Messenger et al. | |
| 6,401,411 | B1 | | 6/2002 | Maglio, Jr. | |
| 6,513,290 | B2 | * | 2/2003 | Leek | 52/295 |
| 6,550,199 | B2 | | 4/2003 | Phillips | |
| 6,668,508 | B2 | * | 12/2003 | Boone et al. | 52/645 |
| 2002/0007613 | A1 | * | 1/2002 | Gordin et al. | 52/726.4 |

OTHER PUBLICATIONS

Brochure—Hoge Buildings, Hoge Lumber Company.

Brochure—Cleary Suburban Buildings, Cleary Building Corp.

Brochure—Borkholder Buildings Agricultural Buildings, Borkholder Buildings.

Brochure—Pacemaker Agricultural Buildings/Post Frame Buildings, Pacemaker Buildings.

Brochure—Wick Agri–Buildings, Wick Agri–Buildings a Product of Wick Building Systems Inc.

Brochure—FBi Buildings, FBi Buildings, Inc.

Brochure—Blitz Builders, Inc., Blitz Builders, Inc.

Brochure—Lester's Post Frame Buildings, Lester's Engineered Building Systems.

Brochure—Stockade Building Systems, Stockade Buildings, Inc.

Brochure—Morton Buildings, The Suburban Series, Morton Buildings.

Brochure—Walters Buildings Agricultural, Commercial, Industrial, Walters Buildings.

Catalog—Technical Publications & Software—Simpson Strong–Tie Company, Inc., 2001, pp. 16–23.

Webpage—www.lancastercomposite.com, Precast FRP Composite Piling and Structures, Jul. 18, 2003.

* cited by examiner 47
47
40
47
40
40
40
47

47
40
40
47
47
40
47
40

48
56
48
48
48
34
56
54
48
48
56
48
48
34
44
48
56
26
46

PRECAST CONCRETE COLUMN FOR USE IN POST-FRAME CONSTRUCTION

BACKGROUND OF THE INVENTION

1. Field of the Invention

The present invention relates to post-frame buildings, and, more particularly, to a column for use in the construction of a post-frame building.

2. Description of the Related Art

Typical post-frame buildings include a series of wooden columns set into the earth and positioned in a geometric configuration generally corresponding to the desired perimeter of a post-frame building. A distal end of each column is set into the earth, while a proximal end is affixed to a truss. Note that for the purposes of this document, the reference point with respect to the use of the words "distal," and "proximal" is taken as the highest point on the post-frame building in question. The body of each column is joined to an adjacent column via a number of generally horizontally placed planks. Such a horizontal placed plank positioned adjacent the earth is generally referred to as a skirt board, while a horizontal plank joining adjacent columns positioned a distance from the earth is generally referred to as a girt. After the skirt board and girts are affixed to the columns, a siding member is attached to the skirt board and girts to define an exterior of the post-frame building. Similarly, adjacent trusses are joined together by wooden planks referred to as purlins. Generally, purlins are positioned substantially transverse to the trusses. A roofing member is affixed to the trusses via the purlin to form an exterior roof of the post-frame building.

Typically, to construct a post-frame building, a series of holes are bored into the earth about the perimeter of the building. The depth of these holes can be, e.g., three to five feet, with adjacent holes being placed on, e.g. four to ten foot centers. After the holes are formed, a concrete pad is positioned in the distal most portion of the hole. Generally, the concrete pad comprises a precast concrete pad having a generally cylindrical shape. After each hole receives a concrete pad, a column is set into each hole and the holes are back-filled with, e.g., gravel to maintain the columns in a vertical orientation. Generally, either solid wood columns or laminated wood columns are utilized in post-frame construction. Laminated columns are typically formed of three or more 2×6's or 2×8's positioned side by side to form the column. Both the solid and laminated columns of the prior art which are set into the earth must be treated with a wood preservative to prevent degradation thereof due, e.g., to insect damage, and/or damage from the elements, e.g., moisture. Planting treated wood columns in the ground can, potentially, have an adverse impact on the environment.

What is needed in the art is a column structure which provides excellent resistance to degradation of its mechanical properties from the exposure to the elements which accompanies its placement in the ground, while providing ease of workability to complete construction of the building above ground and which is environmentally friendly.

SUMMARY OF THE INVENTION

The present invention provides an improved column for use in the construction of a post-frame building. In accordance with the present invention, a two piece column is utilized in the construction of a post-frame building. The two piece column of the present invention generally comprises a foundation column for placement in the earth, with a proximal end thereof protruding from the earth. The proximal end of the foundation column includes a column bracket for joining the foundation column to a wooden column comprising the second portion of the two piece column of the present invention. The foundation column of the present invention comprises a precast concrete column body having a column bracket affixed to a proximal end thereof. The column bracket includes a plurality of apertures to facilitate affixation of the second portion of the two piece column structure thereto.

In one exemplary embodiment, the column bracket is a generally U-shaped structure having a base with a pair of transverse depending arms extending therefrom. The depending arms of the column bracket are spaced to allow placement of a wooden column there between. The depending arms of the column bracket include a plurality of apertures through which a connector such as, e.g., a carriage bolt can be placed. In use, apertures corresponding to those formed in the depending arms of the column bracket will be formed in the wooden column comprising the second portion of the two piece column of the present invention. The wooden column will then be placed intermediate the depending arms of the column bracket with a carriage bolt traversing the apertures in the column bracket and the wooden column. A nut will then be placed in the distal end of the carriage bolt and securely tightened to affix the wooden column to the column bracket.

In one exemplary embodiment, one or more reinforcing bar(s) is affixed to the base of the column bracket opposite the depending arms of the column bracket prior to casting the concrete foundation column. That is, the depending arms of the column bracket extend transversely from one face of the base of the column bracket, while the reinforcing bar(s) extends transversely from the opposite face of the base of the column bracket. Each reinforcing bar is welded to the base of the column bracket and provides the necessary tensile strength to the foundation column. The reinforcing bars described in the detailed description portion of this document comprise steel reinforcing bars, however, any suitable material for providing the requisite tensile strength to the concrete foundation columns disclosed herein may be utilized in accordance with the present invention. The reinforcing bars utilized in accordance with the present invention can be placed in differing configurations as will be further discussed in the detailed description portion of this document. Generally, a plurality of reinforcing bars will be utilized in accordance with the present invention, with the reinforcing bars substantially evenly spaced about a longitudinal axis of the foundation column.

An anchor pin sleeve is secured to and positioned adjacent a distal end of the foundation column. The anchor pin sleeve of the present invention comprises a tubular member having opposite ends allowing access to a hollow interior thereof. In one exemplary embodiment, the anchor pin sleeve is positioned whereby a longitudinal axis thereof intersects a longitudinal axis of the foundation column, with the longitudinal axis of the anchor pin sleeve being substantially transverse to the longitudinal axis of the foundation column. For the purposes of this document, substantially transverse is utilized to describe an arrangement in which a pair of components are perpendicular one to another, or no more than 20° out of perpendicular, i.e., forming the angle of 70° to 110°.

The hollow interior of the anchor pin sleeve is sized to accommodate a anchor pin positioned therein. A anchor pin in accordance with the present invention is a generally cylindrical member having a length greater than the length of the anchor pin sleeve. In one exemplary embodiment, the anchor pin comprises a length of ½" steel reinforcing bar. While the anchor pin sleeve and anchor pin have been described as a hollow cylinder and a cylindrical member, respectively, these structures can have various cross-sectional geometries, including, e.g., elliptical geometries, oval geometries, or various polygonal geometries. Importantly, the exterior cross-sectional geometry of the anchor pin and the interior cross-sectional geometry of the anchor pin sleeve will be shaped whereby the anchor pin is able to traverse the interior of anchor pin sleeve.

When constructing a post-frame building utilizing the foundation column of the present invention, a anchor pin is positioned in the anchor pin sleeve of the foundation column, with one or both ends of the anchor pin protruding from the anchor pin sleeve. The foundation column is then positioned within a hole in the earth and placed atop a concrete pad positioned in the distal portion of the hole. A flowable concrete mixture is placed in the hole to a depth whereby the protruding portion of the anchor pin is covered, thus forming a concrete collar about the distal end of the foundation column. The anchor pin and concrete collar of the present invention cooperate to resist vertical displacement of a foundation column of the present invention.

The present invention advantageously provides a column for use in the construction of a post-frame building having a distal portion for setting into the earth which distal portion is formed of a material which is resistant to degradation of its mechanical properties from exposure to the elements and which is sufficiently strong to support a post-frame construction including the dead load of the building as well as environmental loads, e.g., wind and snow load experienced by the post-frame building. The column of the present invention further advantageously provides an above ground portion thereof formed of wood to facilitate shaping this portion of the column during construction of a post-frame building and, further, to facilitate affixation of additional components of the building including, e.g., trusses, girts, and skirt boards with the use of well known wooden fasteners such as nails and screws.

A column in accordance with the present invention advantageously provides the requisite resistance to the elements, as well as the strength, and workability needed in the construction of post-frame buildings, without requiring the use of treated lumber to form the column.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein:

FIG. 4A is a perspective view of a column bracket/reinforcing bar configuration in accordance with an alternative embodiment of the present invention;

Figure 1:
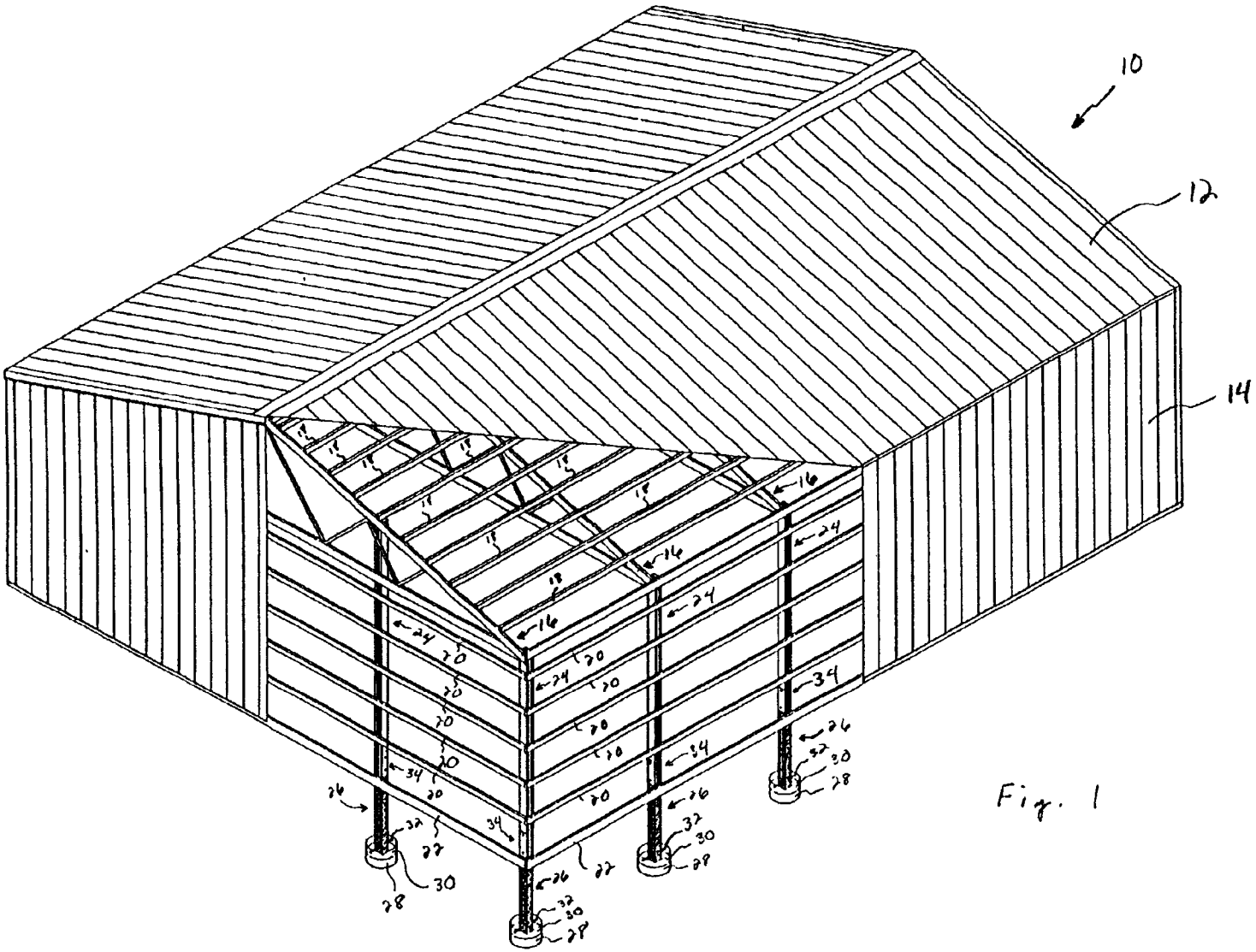
FIG. 1 is a cutaway perspective view of a post-frame building in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, in one form, and such exemplifications are not to be construed as limiting the scope of the invention in any manner.

DETAILED DESCRIPTION OF THE INVENTION

Figure 2:
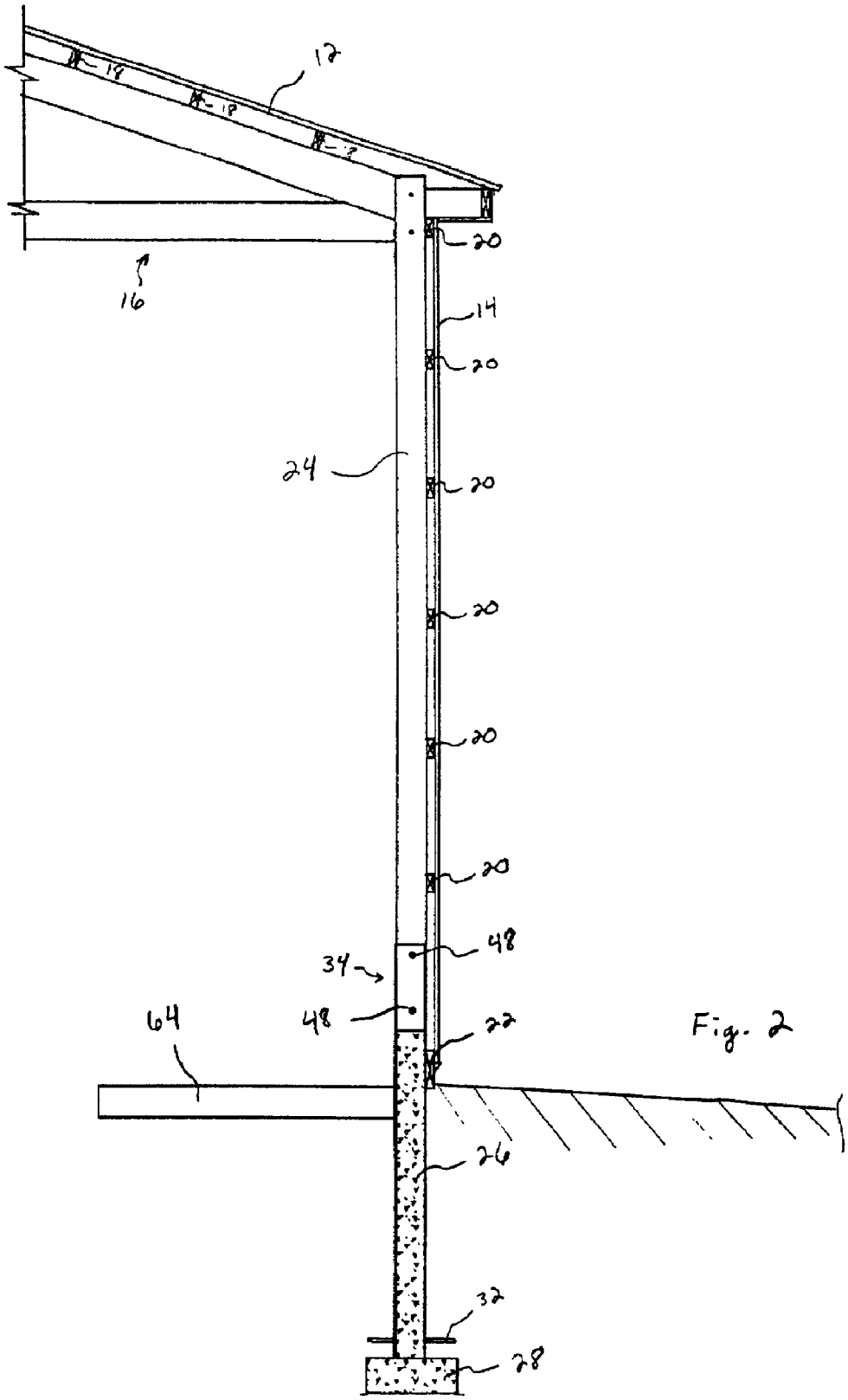
FIG. 2 is a partial plan view of a post-frame building utilizing a column in accordance with the present invention.

A column constructed in accordance with the present invention is illustrated, e.g., in FIGS. 1 and 2. As illustrated in FIGS. 1 and 2, a column of the present invention has a two piece construction including foundation column 26 and wooden column 24. Foundation column 26 is set in the earth with a proximal end thereof protruding from the earth. Wooden column 24 is affixed to the proximal end of foundation column 26 and extends upwardly therefrom.

Figures 3, 4, 5:
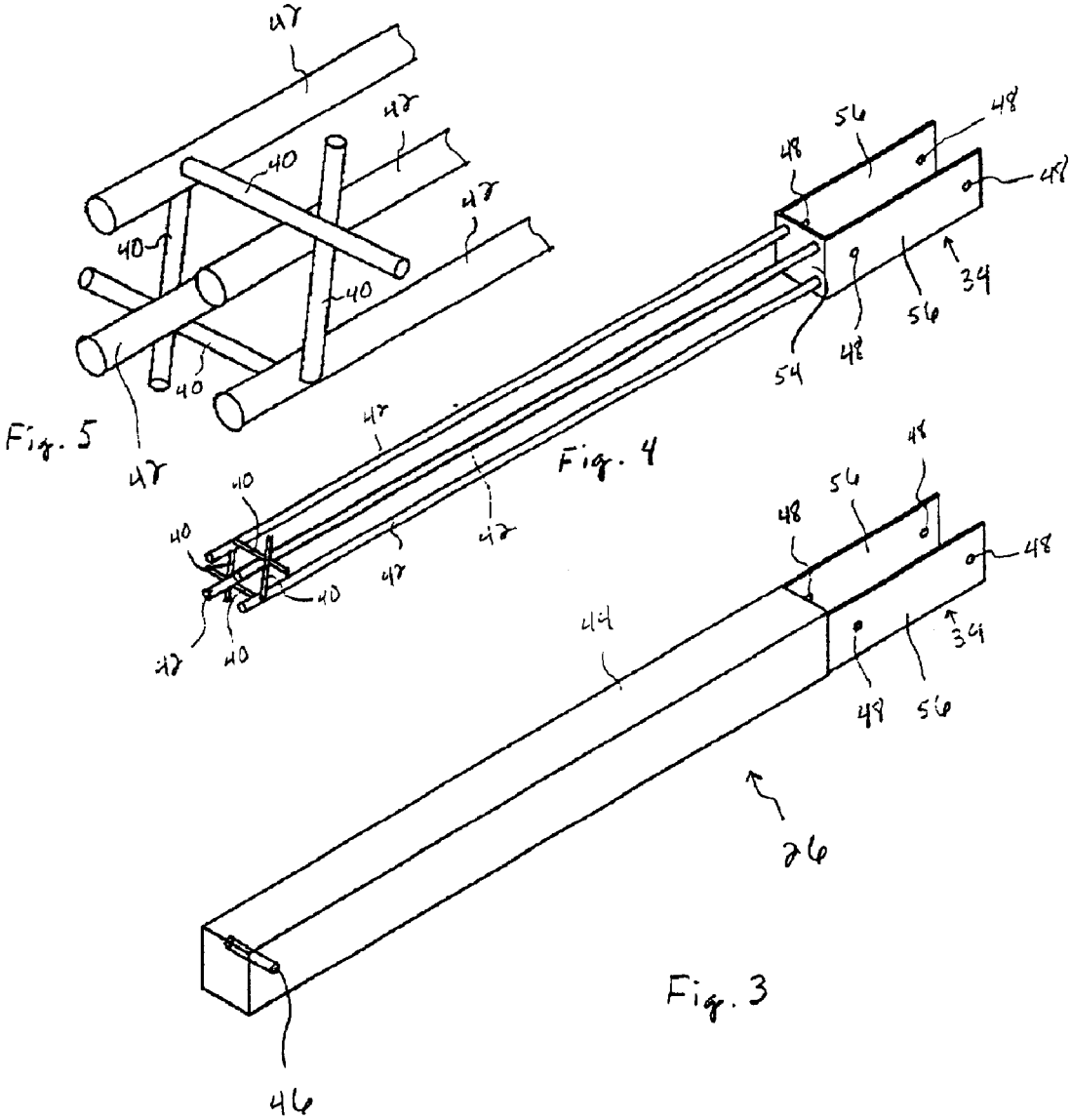
FIG. 3 is a perspective view of one embodiment of a foundation column in accordance with the present invention.
FIG. 4 is a perspective view of the column connector and reinforcing bar configuration utilized in accordance with an embodiment of the present invention.
FIG. 5 is a partial perspective view of the distal portion of the reinforcing bar utilized to construct a foundation column in accordance with one embodiment of the present invention.

Alternative embodiments of foundation column 26 are illustrated in FIGS. 3–6. As illustrated in FIG. 3, one embodiment of foundation column 26 includes precast concrete column body 44 having a substantially consistent cross-sectional area with anchor pin sleeve 46 positioned adjacent a distal end of precast concrete column body 44 and column bracket 34 positioned adjacent a proximal end of precast concrete column body 44. Anchor pin sleeve 46 comprises a hollow cylindrical member sized to accommodate anchor pin 32 (FIG. 2). In one exemplary embodiment, anchor pin sleeve 46 is a ⅝" inner diameter sleeve.

As illustrated in FIGS. 3, 3A, 4, and 4A, as well as FIGS. 7–10, column bracket 34 is generally U-shaped with depending arms 56 extending from base 54. Depending arms 56 are substantially perpendicular to base 54 and are spaced whereby column 24 may be positioned intermediate depending arms 56. Column bracket is formed of steel, e.g., ⅛" to ½" steel and can be formed in a variety of ways, including, e.g., creating a pair of substantially 90° bends in a planar piece of stock material using a bending brake press or other suitable metal bending apparatus, welding a pair of L-shaped brackets one to the other, or welding together three discrete pieces comprising the two depending arms 56 and base 54 of column bracket 34.

Figure 7:
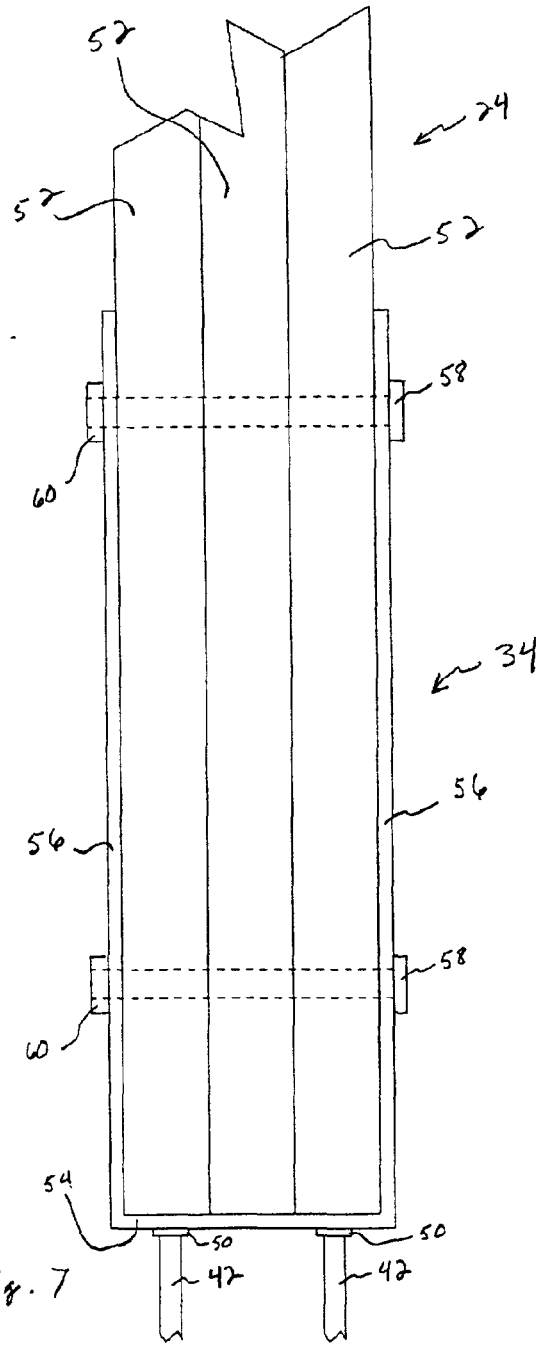
FIG. 7 is a partial plan view illustrating affixation of a wooden column to a column bracket of the present invention and further illustrating affixation of reinforcing bar to a distal portion of the base of a column bracket in accordance with the present invention.
Figure 10:
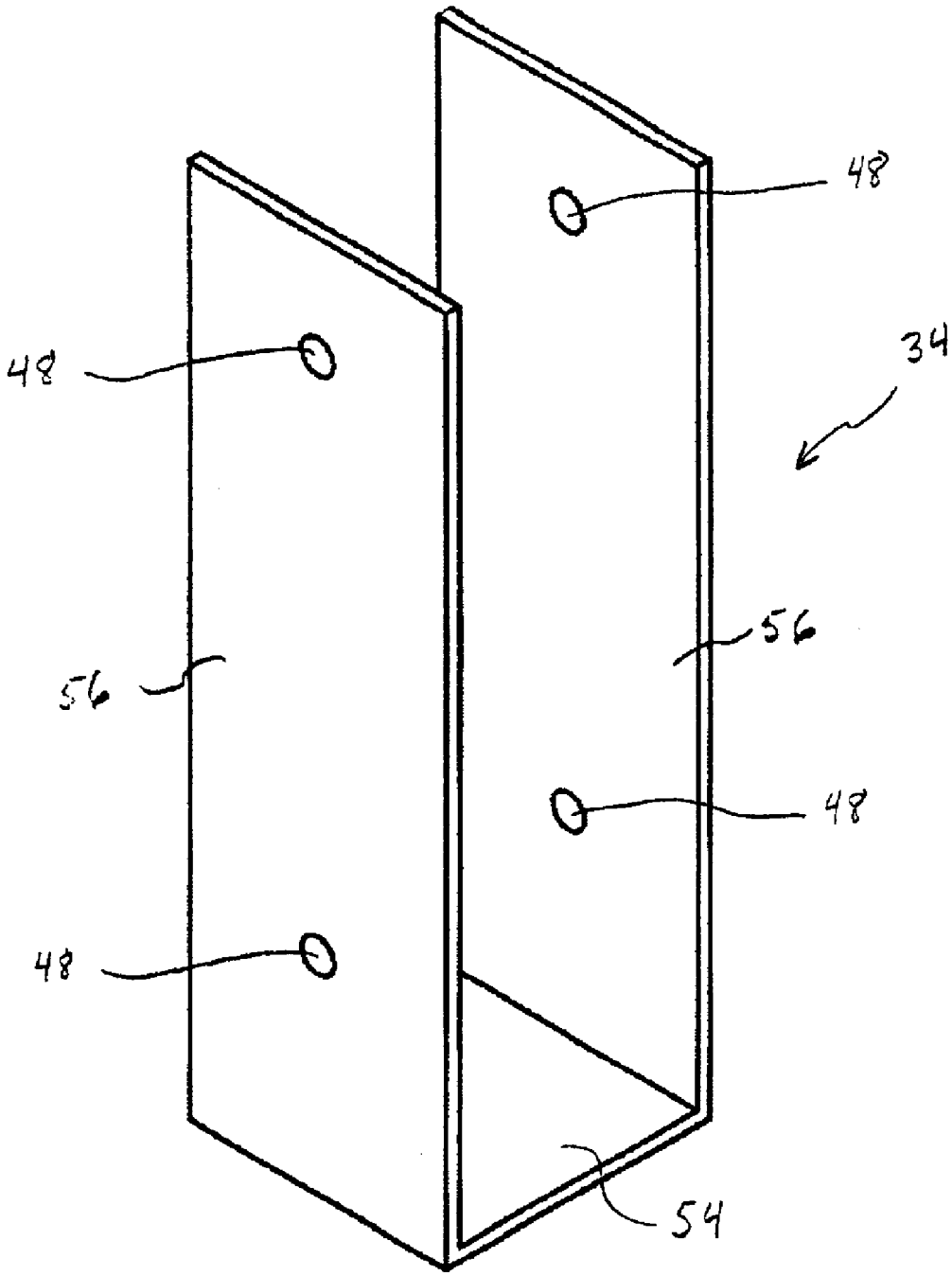
FIG. 10 is a perspective view of a column bracket of the present invention.

In the embodiment illustrated in FIG. 7, wood column 24 comprises a laminated column formed of three discrete wood planks 52. In alternative embodiments, wood column 24 comprises a solid wood column. Column bracket 34 in accordance with the present invention can be formed in various sizes to accommodate varying wooden columns 24 of differing sizes and construction, including, e.g., solid wooden columns and laminated wooden columns. In one embodiment, the inner faces of depending arms 56 will be separated by a distance equal to the width of the desired wood column 24 plus ⅛" to ½" to facilitate placement of wood column 24 intermediate depending arms 56 and adjacent to base 54.

FIG. 4 illustrates one configuration of reinforcing bars 42 with respect to column bracket 34. As illustrated in FIG. 4, reinforcing bars 42 are substantially evenly spaced about base 54 of column bracket 34. As illustrated in FIG. 7, reinforcing bars 42 are affixed to base 54 of column bracket 34 via welds 50. In the embodiment illustrated in FIG. 7, reinforcing bars 42 are placed in abutting relationship with a distal face of base 54 and are welded thereto. Various alternative methods of affixing reinforcing bars 42 to base 54 of column bracket 34 may be utilized in accordance with the present invention, including, e.g., forming apertures in base 54 to accommodate placement of reinforcing bars 42 therethrough and subsequently welding reinforcing bars 42 to both faces of base 54.

Referring to FIG. 4, reinforcing bar spacers 40 are utilized to maintain the spaced relationship of reinforcing bars 42. Reinforcing bar spacers 40 are affixed to adjacent reinforcing bars via, e.g., welds and maintain the relative position of reinforcing bars 42 along the length thereof. Reinforcing bar spacers 40 illustrated in FIG. 5 have a length whereby a portion of reinforcing bar spacer 40 extends past at least one reinforcing bar 42. In alternative embodiments, reinforcing bar spacers 40 maintain the spaced relationship of reinforcing bars 42 and do not extend beyond reinforcing bars 42. In one exemplary embodiment, reinforcing bar spacers 40 are substantially transversely positioned with respect to reinforcing bars 42. In one embodiment, reinforcing bar spacers 40 are L-shaped. In this embodiment, only two spacers 40 are required.

FIG. 4A illustrates an alternative embodiment of the reinforcing bar/column bracket configuration of a foundation column of the present invention. As illustrated in FIG. 4A, a pair of U-shaped reinforcing bars 42*a* are affixed to the distal face of base 54 of column bracket 34. In this configuration, U-shaped reinforcing bars 42*a* have sufficient structural rigidity to substantially maintain the space apart relationship of the upright portions thereof, i.e., the "arms" of U-shaped reinforcing bars 42*a*.

In various exemplary embodiments of the present invention, reinforcing bar is positioned within a foundation column in a configuration in which the reinforcing bar will add tensile strength to every face of the foundation column. In practice, adding tensile strength to the face of a foundation column adjacent the building siding is of the greatest importance, as wind load on the side of a post-frame building can place a significant force on the foundation column, tending to flex a proximal end of the foundation column toward the interior of the building in question. Because reinforcing bar is positioned to add tensile strength to every face of the foundation column, an installer need not be concerned with the proper rotational configuration of a foundation post of the present invention to ensure that reinforcing bar is positioned adjacent the face of the foundation column adjacent the building siding. Generally, a sufficient amount of reinforcing bar to withstand at least an 80 mph wind force is utilized in a foundation column of the present invention.

Figure 3A:
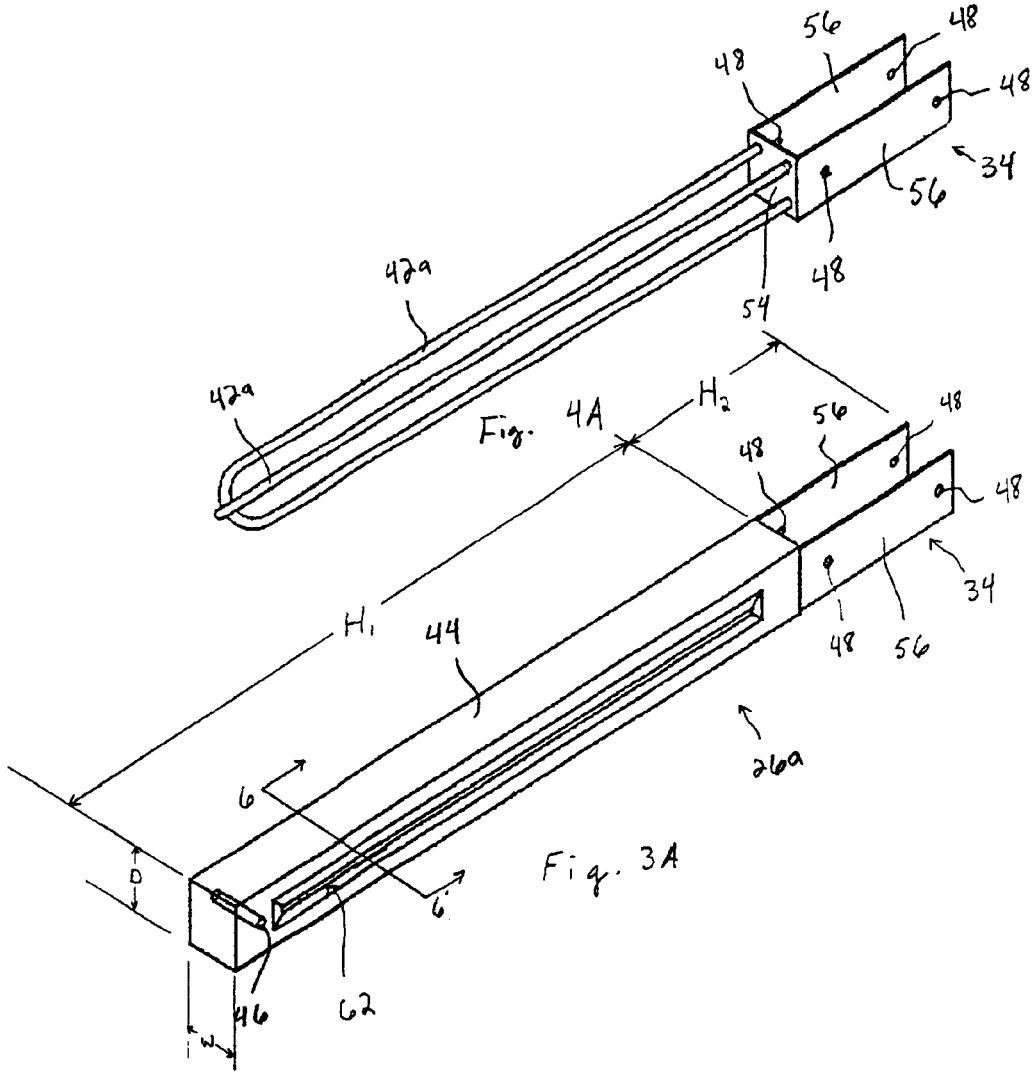
FIG. 3A is a perspective view of an alternative embodiment foundation column in accordance with the present invention.
Figure 6:
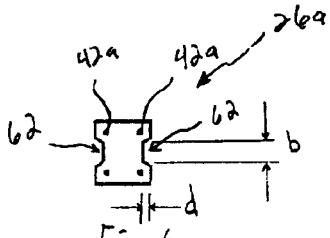
FIG. 6 is a sectional view of a foundation column of the present invention taken along lines 6–6' of FIG. 3A.

In construction, reinforcing bars 42 or 42*a* will be positioned within a mold along with anchor pin sleeve 46. A concrete mixture is then poured into the mold and sets to form a complete foundation column 26 or 26*a* (FIGS. 3, 3A). Generally, foundation columns 26, 26*a* comprise 4000–8500 psi precast concrete columns. Foundation column 26*a* of FIG. 3A includes bevels 62, while foundation column 26 illustrated in FIG. 3 has four substantially continuous sides. As illustrated in FIG. 6, foundation column 26*a* includes a pair of bevels 62 on opposing sides thereof. As illustrated in FIG. 6, bevel 62 terminate in a base b which is substantially parallel to the face of foundation column 26*a* in which bevel 62 is formed. In one exemplary embodiment, base b is 1 to 2 inches long and depth d is ¾–1½ inches. Referring to FIG. 3A, the dimensions of an exemplary foundation columns 26*a* are as follows: depth (D) of about 5½–7½ inches, width (W) of about 4⅝–6⅛ inches, height of column body 44 ($H_1$) of about 5 feet, and height of column bracket 34 ($H_2$) of about 12–24 inches. Exemplary foundation columns 26 are formed of similar dimensions.

Figure 9:
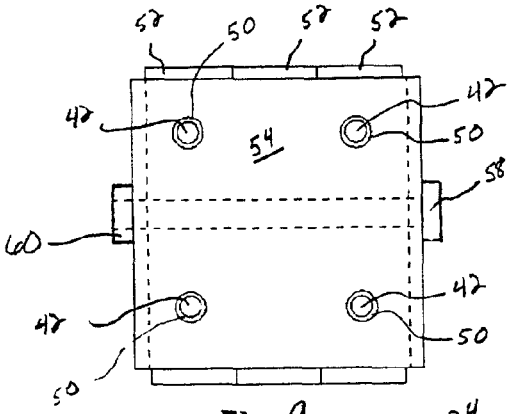
FIG. 9 is a bottom plan view thereof.
Figure 8:
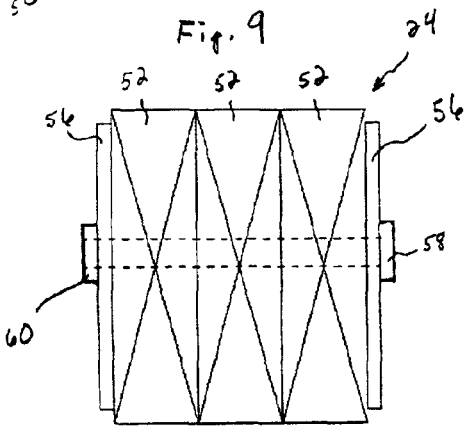
FIG. 8 is a top plan view of the wooden column/column bracket configuration of FIG. 7.

FIGS. 7–9 illustrate affixation of wooden column 24 to column bracket 34. As illustrated, e.g., in FIG. 10, column bracket 34 includes four apertures 48 through which a fastener may be placed. As illustrated in FIGS. 7–9, one appropriate fastener utilized to affix wooden column 24 to column bracket 34 comprises carriage bolt 58 and nut 60. As illustrated in FIG. 7, a pair of apertures are formed through wooden column 24 whereby carriage bolt 58 traverses a first aperture 48 in column bracket 34, thereafter traverses an aperture in wooden column 24, and finally traverses a second aperture 48 in column bracket 34. Nut 60 is thereafter secured to carriage bolt 58 to secure wooden column 24 to column bracket 34. In the embodiment illustrated in FIGS. 7–10, a pair of carriage bolts 58 and nuts 60 are utilized to affix wooden column 24 to column bracket 34. In one exemplary embodiment, apertures 48 are 9/16" apertures and carriage bolts 56 are ½" carriage bolts.

To construct post-frame building 10 illustrated in FIG. 1, a series of holes in the earth are made about the perimeter of building 10 to accommodate concrete pads 28 and foundation columns 26. Concrete pads 28 are positioned in the distal most region of these holes and foundation columns 26, with anchor pins 32 positioned through anchor pin sleeves 46 (see, e.g., FIG. 3) are positioned within the holes and placed atop concrete pads 28. Foundation columns 26 are generally positioned with depending arms 56 of column bracket 34 substantially perpendicular to a plane in which siding member 14 will be positioned. With foundation columns 26 substantially vertically positioned, concrete collars 30 are poured. The holes are thereafter back-filled to maintain the vertical position of foundation columns 26. Columns 24 are affixed to column brackets 34 as described hereinabove and skirt board 22, girts 20, trusses 16, purlins 18, siding member 14, and roofing member 12 are assembled to complete the construction of building 10. Fastening mechanisms including, e.g., screws and nails may be utilized to affix various wooden members of post-frame building 10 as well as siding member 14 and roofing member 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within know or customary practice in the art to which this invention pertains and which fall within the limits of the appended claims.

What is claimed is:

1. A column for providing a vertical support to a building, the column comprising:

a concrete foundation column for planting in an area of earth, a proximal end of said foundation column protruding from said earth when said concrete foundation column is planted therein; and a wood column, said wood column secured to said proximal end of said concrete foundation column, said wood column substantially vertically oriented, wherein said foundation column includes at least one reinforcing bar therein, wherein a proximal end of said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, said wood column positioned intermediate said arms said wood column secured to said foundation columns via said column bracket.

2. A column for providing a vertical support to a building, the column comprising:

a concrete foundation column for planting in an area of earth, a proximal end of said foundation column protruding from said earth when said concrete foundation column is planted therein; and a wood column, said wood column secured to said proximal end of said concrete foundation column, said wood column substantially vertically oriented, wherein said foundation column includes at least one U-shaped reinforcing bar therein, wherein said U-shaped reinforcing bar has a pair of ends, said pair of ends affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, said wood column positioned intermediate said arms, said wood column secured to said foundation columns via said column bracket.

3. A column for providing a vertical support to a building, the column comprising:

a concrete foundation column for planting in an area of earth, a proximal end of said foundation column protruding from said earth when said concrete foundation column is planted therein; and a wood column, said wood column secured to said proximal end of said concrete foundation column, said wood column substantially vertically oriented, wherein said foundation column includes four reinforcing bars, said reinforcing bars substantially evenly spaced about a longitudinal axis of said foundation column, wherein a proximal end of each said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, said wood column positioned intermediate said arms, said wood column secured to said foundation columns via said column bracket, said foundation column having a plurality of reinforcing bar spacers, each said reinforcing bar spacer affixed to an adjacent pair of reinforcing bars, said reinforcing bar spacers affixed to a substantially distal end of said reinforcing bars.

4. A column for providing a vertical support to a building, the column comprising:

a concrete foundation column for planting in an area of earth, a proximal end of said foundation column protruding from said earth when said concrete foundation column is planted therein; and a wood column, said wood column secured to said proximal end of said concrete foundation column, said wood column substantially vertically oriented, wherein said foundation column includes a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, said wood column positioned intermediate said arms, said wood column secured to said foundation columns via said column bracket.

5. A post-frame building, comprising:

a plurality of concrete foundation columns, each said foundation column planted in an area of earth, a proximal end of each said concrete foundation column protruding from said earth;

a plurality of wood columns, said columns secured to said proximal ends of said concrete foundation columns; and a roofing member attached to said columns, said roofing member defining an exterior roof of the building, said roofing member substantially entirely covering a foot print of the building;

wherein each said foundation column comprises a precast concrete column:

wherein each said foundation column contains at least one reinforcing bar therein; and wherein a proximal end of said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, one of said wood columns positioned intermediate said arms, said wood columns secured to said foundation columns via said column bracket.

6. A post-frame building, comprising:.

a plurality of concrete foundation columns, each said foundation column planted in an area of earth, a proximal end of each said concrete foundation column protruding from said earth;

a plurality of wood columns, said columns secured to said proximal ends of said concrete foundation columns; and a roofing member attached to said columns, said roofing member defining an exterior roof of the building, said roofing member substantially entirely covering a foot print of the building;

wherein each said foundation column comprises a precast concrete column:

wherein each said foundation column contains at least one U-shaped reinforcing bar therein; and wherein said U-shaped reinforcing bar has a pair of ends, said pair of ends affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, one of said wood columns positioned intermediate said arms, said wood columns secured to said foundation columns via said column bracket.

7. A post-frame building, comprising:

a plurality of concrete foundation columns, each said foundation column planted in an area of earth, a proximal end of each said concrete foundation column protruding from said earth;

a plurality of wood columns, said columns secured to said proximal ends of said concrete foundation columns; and a roofing member attached to said columns, said roofing member defining an exterior roof of the building, said roofing member substantially entirely covering a foot print of the building;

wherein each said foundation column comprises a precast concrete column:

wherein each said foundation column contains four reinforcing bars, said reinforcing bars substantially evenly spaced about a longitudinal axis of said foundation column; and wherein a proximal end of each said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, one of said wood columns positioned intermediate said arms, said wood columns secured to said foundation columns via said column bracket, said foundation column having a plurality of reinforcing bar spacers, each said reinforcing bar spacer affixed to an adjacent pair of reinforcing bars, said reinforcing bar spacers affixed to a substantially distal end of said reinforcing bars.

8. A post-frame building, comprising:

a plurality of concrete foundation columns, each said foundation column planted in an area of earth, a proximal end of each said concrete foundation column protruding from said earth;

a plurality of wood columns, said columns secured to said proximal ends of said concrete foundation columns; and a roofing member attached to said columns, said roofing member defining an exterior roof of the building, said roofing member substantially entirely covering a foot print of the building, wherein each said-foundation column includes a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, one of said wood columns positioned intermediate said arms, said wood columns secured to said foundation columns via said column bracket.

9. A method of constructing a post-frame building, comprising:

planting a plurality of concrete foundation columns in the earth about a perimeter of the building, said concrete foundation column having a first transverse cross-sectional area;

affixing a wood column to each said foundation column, said wood column being substantially vertically oriented when affixed to said foundation column, said wood column having a second transverse cross-sectional area, said first cross-sectional area and said second cross-sectional area being substantially equal; and constructing the building using the wood columns as vertical supports, wherein each said foundation column contains at least one reinforcing bar therein; wherein a proximal end of said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, and wherein said step of affixing a wood column to each said foundation column comprises the steps of:

positioning said wood column intermediate said arms; and securing said wood column to said foundation columns via said column bracket.

10. A method of constructing a post-frame building, comprising:

planting a plurality of concrete foundation columns in the earth about a perimeter of the building, said concrete foundation column having a first transverse cross-sectional area;

affixing a wood column to each said foundation column, said wood column being substantially vertically oriented when affixed to said foundation column, said wood column having a second transverse cross-sectional area, said first cross-sectional area and said second cross-sectional area being substantially equal; and constructing the building using the wood columns as vertical supports, wherein each said foundation column contains at least one U-shaped reinforcing bar therein, wherein said U-shaped reinforcing bar has a pair of ends, said pair of ends affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, and wherein said step of affixing a wood column to each said foundation column comprises the steps of:

positioning said wood column intermediate said arms; and securing said wood column to said foundation columns via said column bracket.

11. A method of constructing a post-frame building, comprising:

planting a plurality of concrete foundation columns in the earth about a perimeter of the building, said concrete foundation column having a first transverse cross-sectional area;

affixing a wood column to each said foundation column, said wood column being substantially vertically oriented when affixed to said foundation column, said wood column having a second transverse cross-sectional area, said first cross-sectional area and said second cross-sectional area being substantially equal; and constructing the building using the wood columns as vertical supports, wherein each said foundation column contains four reinforcing bars, said reinforcing bars substantially evenly spaced about a longitudinal axis of said foundation column, wherein a proximal end of each said reinforcing bar is affixed to a column bracket, said column bracket positioned adjacent a proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, said foundation column having a plurality of reinforcing bar spacers, each said reinforcing bar spacer affixed to an adjacent pair of reinforcing bars, said reinforcing bar spacers affixed to a substantially distal end of said reinforcing bars, and wherein said step of affixing a wood column to each said foundation column comprises the steps of:

positioning said wood column intermediate said arms; and securing said wood column to said foundation columns via said column bracket.

12. A method of constructing a post-frame building, comprising:

planting a plurality of concrete foundation columns in the earth about a perimeter of the building wherein a proximal end of each of said concrete foundation columns protrudes from the earth;

affixing a wood column to each said foundation column, said wood column being substantially vertically oriented when affixed to foundation column; and constructing the building using the wood columns as vertical supports, wherein said foundation column includes a column bracket, said column bracket positioned adjacent a said proximal end of a concrete column body of said foundation column, said column bracket comprising a base and a pair of depending arms extending from said base, said base positioned adjacent said proximal end of said concrete column body of said foundation column, said arms extending proximally from said proximal end of said concrete column body, and wherein said step of affixing a wood column to each said foundation column comprises the steps of:

positioning said wood column intermediate said arms; and securing said wood column to said foundation columns via said column bracket.

* * * * *